US009765578B2

(12) United States Patent
Bowman

(10) Patent No.: US 9,765,578 B2
(45) Date of Patent: Sep. 19, 2017

(54) SANITARY CHECK VALVE TO PREVENT WELL CONTAMINATION

(71) Applicant: Jeremy W. Bowman, Cedar City, UT (US)

(72) Inventor: Jeremy W. Bowman, Cedar City, UT (US)

( * ) Notice: Subject to any disclaimer, the term of this patent is extended or adjusted under 35 U.S.C. 154(b) by 378 days.

(21) Appl. No.: 14/558,125

(22) Filed: Dec. 2, 2014

(65) Prior Publication Data

US 2016/0153261 A1 Jun. 2, 2016

(51) Int. Cl.

| | |
|---|---|
| ***E21B 33/00*** | (2006.01) |
| ***E21B 34/06*** | (2006.01) |
| ***E21B 19/00*** | (2006.01) |
| ***E21B 33/037*** | (2006.01) |

(52) U.S. Cl.
CPC ..... *E21B 19/002* (2013.01); *E21B 33/00* (2013.01); *E21B 33/037* (2013.01); *E21B 34/06* (2013.01)

(58) Field of Classification Search
CPC ..... E21B 33/00; E21B 34/06
USPC ..... 166/85.2
See application file for complete search history.

(56) References Cited

U.S. PATENT DOCUMENTS

| | | | | |
|---|---|---|---|---|
| 2,829,597 A * | 4/1958 | Patterson | ..... | F04D 13/10 166/53 |
| 3,812,910 A * | 5/1974 | Wellstein | ..... | E21B 33/00 166/85.2 |
| 5,439,052 A * | 8/1995 | Skinner | ..... | E21B 33/00 137/625.46 |

* cited by examiner

*Primary Examiner* — Giovanna C Wright
(74) *Attorney, Agent, or Firm* — M. Reid Russell

(57) ABSTRACT

A sanitary check valve arranged between a drop and outlet pipes in a water well casing that will prevent operate to block a back flow of water through the drop pipe when pumping from a water source is discontinued as could contaminate that water source. The valve is for fitting into an actuator fitting body that mounts between the drop and outlet pipes opposite ends and includes a side plate for releasable coupling to a separate actuator mount that connects through the well casing and includes a drain pipe. The drop and outlet pipes fitted to the fitting body are lowered into the well casing to where the side plate edges slid between parallel sides of the mount, coupling the assembly together such that an upward water flow moves the float valve off of the drop pipe end to pass that flow through the outlet pipe for use, and, when that upward flow is stopped, the valve closes over the drop pipe end and opens to the mount drain pipe to a water flow that dumps outside the well casing.

1 Claim, 10 Drawing Sheets

SANITARY CHECK VALVE TO PREVENT WELL CONTAMINATION

BACKGROUND OF THE INVENTION

Field of the Invention

This invention relates to sanitary drain fittings for connection to a water well head and is for automatically stopping flow from a water well pipe up stream from a down well water pump that feeds, for example, a stock tank, and allows water above the frost line to drain out of the water well pipe in a sanitary manner, avoiding damage to the down well water pump as will occur should the pump be operated to pump against a head of water frozen in a pipe above the frost line.

Prior Art

For down well water pumps that pump water to above the frost line, as into a stock tank, there exists a present need for an automatic, frost free, sanitary drain fitting for installation below at a water well head. When using a well for above ground applications, where the outlet pipe is exposed to freezing temperatures, the outlet pipe needs to drain below the frost line to avoid freezing in winter conditions, so as to avoid pumping against an ice plug that could damage the pump.

Heretofore, water wells have often been removed from service to avoid pump damage in freezing conditions, or the well exposed piping has been arranged to let water therein drain directly back into the well, potentially creating water well contamination. An example of such back flow arrangement for above-ground piping is outlined in instructions from Lorentz, the manufacturer of a pitless adaptor, that is shown as Prior Art in the Drawing Section of the present application, and which pitless adaptor is shown fitted with the sanitary drain valve of the invention. Where the Lorentz instructions call for forming a "weep hole" in a "drop pipe" that the pitless adaptor connects to, such that, when pumping is discontinued, water above the drop pipe will flow down the "drop pipe" and back to and through the "weep hole" and into the well casing. Which arrangement of forming such a "weep hole" and its draining back into the well casing may cause contamination of the well water, and is illegal.

The invention provides embodiments of a water well check valve that meets the requirements for being a legal sanitary valve in that it will not pass water back into the well when the pump is turned off. The check valve embodiments are each arranged is to be contained in a fitting body of an adapter arranged in the a well piping, and below the frost line. Which adapter is preferably a pitless adapter. Each check valve embodiment of the invention, with the pump operating, keeps a column of water flowing through a well outlet pipe for surface use, and closes when the pump is stopped to direct a water back flow from the outlet pipe and check valve through a drain pipe that passes through the adapter mount that dumps outside of the well casing, prohibiting a back flow into the well.

SUMMARY OF THE INVENTION

It is a principal object of the present invention to provide an automatic, frost free sanitary drain fitting for installation below the frost line below a water well head that passes pumped water for an above ground application where well head and outlet pipe are potentially exposed to freezing conditions.

Another object of the present invention is to provide a water flow operated check valve assembly that is contained within a fitting body of an adapter that is connected between a top end of a well drop pipe and a bottom end of an outlet pipe where a mount component of the adapter is fitted through an opening formed through a well casing, and which adapter fitting body includes a separate side plate that is for releaseable attachment to the adapter mount in the assembly of the pump, drop pipe, fitting body and outlet pipe in a well casing, and which fitting body connects between drop pipe and outlet pipe end and contains the check valve that is operated by a presence of a pumped water flow through the drop pipe upper end and out through the outlet pipe for surface use, and the absence of such water flow when the pump is turned off, with the check valve operated to drain water out from the fitting body to beyond the well casing through a drain pipe.

Another object of the present invention is to provide embodiments of check valves that each allow water to flow up from the down well pump, that passes through the check valve and through an outlet pipe, and provides for directing trapped water above the check valve back through the adapter and out through a drain pipe to outside of the well casing when the pump is shut off, prohibiting water from remaining in the outlet pipe and check valve that could freeze and block a pumped flow of water from the down well should the pump be turned back on.

Still another object of the present invention is to provide a check valve that includes a float or pivoting plate that automatically changes position from allowing flow out through the outlet pipe when the pump is operating, that will move its position to block that flow to the outlet pipe and direct water into a drain pipe that dumps outside of the well casing when the pump is shut off.

Still another object of the present invention is to provide for automatically draining the water from the outlet pipe and check valve above the frost line as could freeze and for passing that trapped water to outside of the well casing.

Principal features of the invention include a check valve that preferably fits into a fitting body of an adapter, such as a pitless adapter, that connects through an adapter mount that is fitted through a well casing wall that attaches to a drain pipe to drain water from the check valve and outlet pipe when the down well pump is turned off. The check valve is arranged in the adapter fitting body that is coupled onto an upper end of a drop pipe and a lower end of an outlet pipe, and mounts a side plate that is open therethrough to the side thereof that is arranged to slide between opposing flanges of an adapter mount that is fitted across an opening through the well casing that includes a drain pipe. Which side fitting together of the adapter side plate and mount is accomplished by lowering the assembly of the pump, drop pipe, fitting body and outlet pipe into the well casing so as to releasably attach the adapter side plate and mount together. The adapter mount is preferably installed through the well casing during construction and is connected to a drain pipe to pass water therethrough, that will pass into the dirt or gravel outside of the well casing, and which adapter fitting body contains the check valve and connects to the outlet pipe that passes water for a surface use.

The embodiments of the check valve are each arranged to lift off of the pump drop pipe open end when water is flowing therethrough, and will close over the pump drop pipe end when that water flow is discontinued, as when the down well pump is turned off. With, when the pump is turned off and the check valve closed over the open end of the pump drop pipe, all water that remains in the pitless adapter housing and outlet pipe will drain through the adapter and into the drain pipe.

In operation, the check valve directs water flow from the outlet pipe and check valve, that are above the frost line, into the drain pipe, avoiding a presence water therein as could freeze and plug the check valve and outlet pipe, blocking water flow therethrough, should the pump be turned on.

The invention in a check valve, as shown below, sets out several check valve configurations that each will perform the same functions though, it should be understood, other valve configurations that include a valve arrangement mounted within fitting body like that of the pitless adapter body, as shown, that are biased to close over the end of a drop pipe when pump operations are discontinued, will come within the scope of the present disclosure and invention.

DESCRIPTION OF THE DRAWINGS

In the drawings which illustrate that which is presently regarded as the best mode for carrying out the invention.

DETAILED DESCRIPTION OF THE INVENTION

Figure 1:
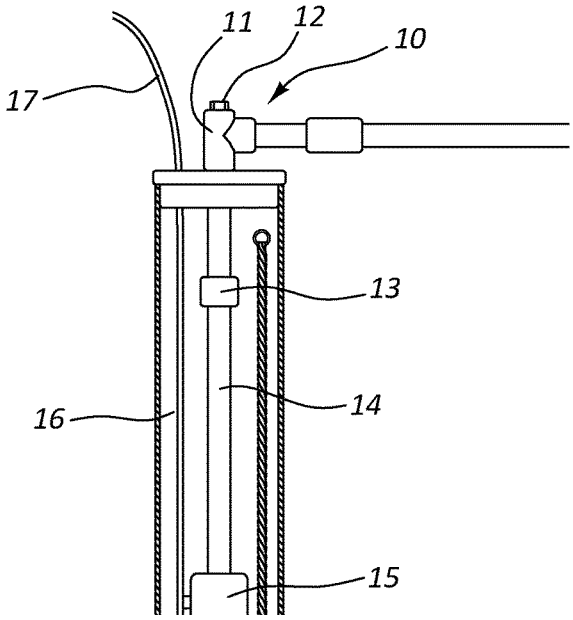
FIG. 1 (Prior Art)
FIG. 1 is identified as Prior Art and is an example of a utilization of a standard well head that may or may not incorporate a pitless adapter as which well head.

FIG. 1, is identified as Prior Art, and shows a standard plumbing tee on top of a well casing 16 that has a drop pipe 14 fitted therein that a down well water pump 15, shown as a block, is connected to and is to pump water therethrough, and shows an electrical cable 17 extending from the top of the well casing 16 and connects to the pump 15, for providing and controlling power to the pump.

Figure 2:
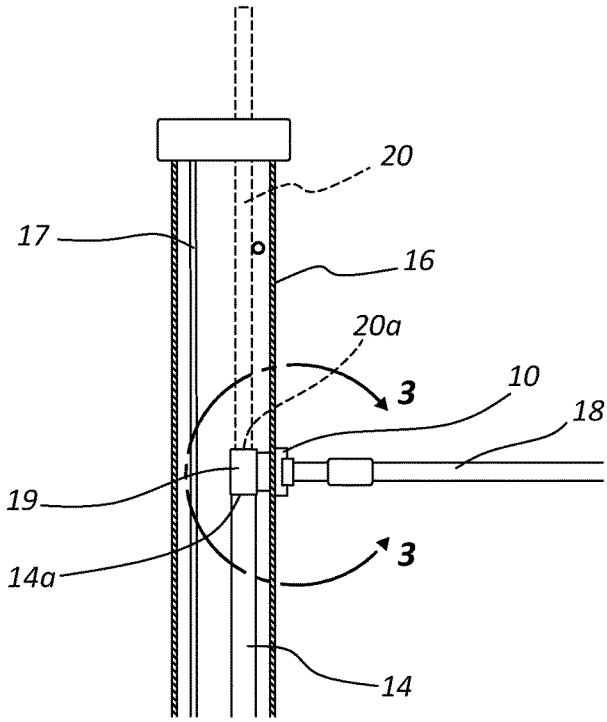
FIG. 2 (Prior Art)
FIG. 2 is also identified as Prior Art and shows an example of a utilization of a use of the pitless adapter that includes a drain pipe fitted through a side of a well casing and includes an outlet pipe that water pumped from a pump in the well casing as it would be used with the invention.

FIG. 2, is also identified as Prior Art, and shows another arrangement of the pitless adapter 10 fitted through the side of the well casing 16 and mounts an outlet pipe 18 wherethrough a flow of water passes into a collection vessel, not shown. In this arrangement, the pitless adapter 10 is shown fitted in the well casing at a depth below the frost level. With the down well pump turned off, water could freeze in the outlet pipe and block flow, potentially damaging the down well pump should the pump be turned on. The pitless adapter, as show, receives a puller pipe 20 turned therein, and as shown in broken lines, to be removable. FIG. 2 shows a pitless adapter 10 located below a freeze line, and, should water in the outlet pipe 18 freeze, along with a vessel that the outlet pipe 18 feeds, such could present a blockage to pumping. To handle which possibility, the Lorentz Company, manufacturer of the pump 15, suggests that a small hole be drilled through the drop pipe 14, below the front line, to create a vent to allow the water in the fitting body and the outlet pipe to drain water through the drop pipe and into the well casing 16. Such, however, would create an unsanitary condition as the drained water would flow into the water source that the down well pump draws from, potentially contaminating that water source. Which back flow is both unsanitary and illegal.

Installation of the present invention in a sanitary float valve, or check valve, in a water well outlet pipe precludes problems of a presence of frozen water in the valve and outlet pipe while avoiding a possibility of contamination to a water source that the down well pump draws water from.

The invention, shown as several embodiments of check valves, shown in FIGS. 8 through 13, that are herein discussed below. Each embodiment of the check valve is preferably for fitting into the pitless adapter 10, or into an adapter that is like the pitless adapter, and which pitless adapter or adapter has a fitting body that is of a size for accommodating the check valve components therein. All the check valves embodiments provide for free passage of water through which adapter 10, and out of outlet pipe 30 when water is being pumped from the ground water source. When the down well pump 15 is stopped, as by operation of a tank float, not shown, or the like, that discontinues a flow of electricity to which down well pump 15, the check valve will operate to close over the drop pipe 14 top end 14*a*. Whereafter, water in the outlet pipe 30 and check will pass through the adapter 10 body 19 and out of a drain pipe 18, draining outside of the well casing 16.

Figure 3:
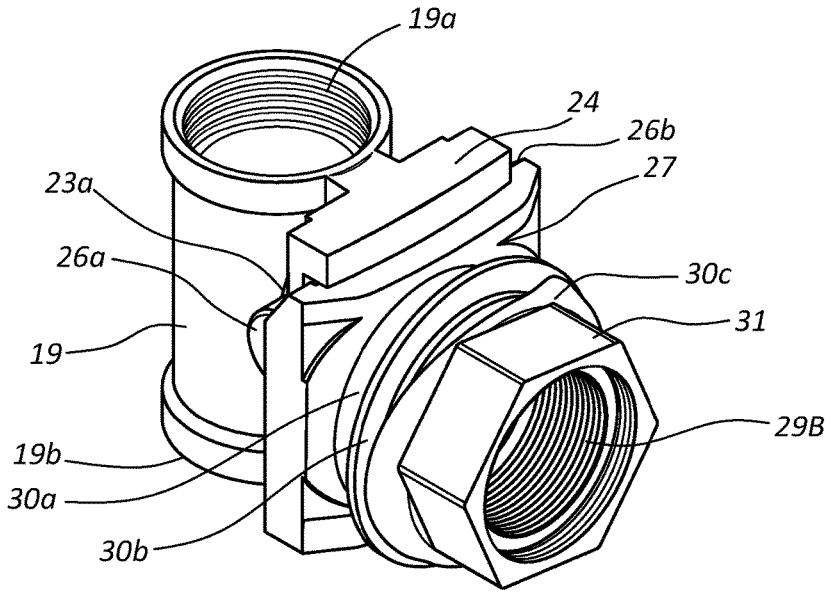
FIG. 3 (Prior Art)
FIG. 3 is also identified as Prior Art and is a sectional view taken within the line 3-3 of FIG. 2, and shows an expanded profile perspective view of the pitless adapter as including a fitting body as the invention would be fitted into.
Figure 3A:
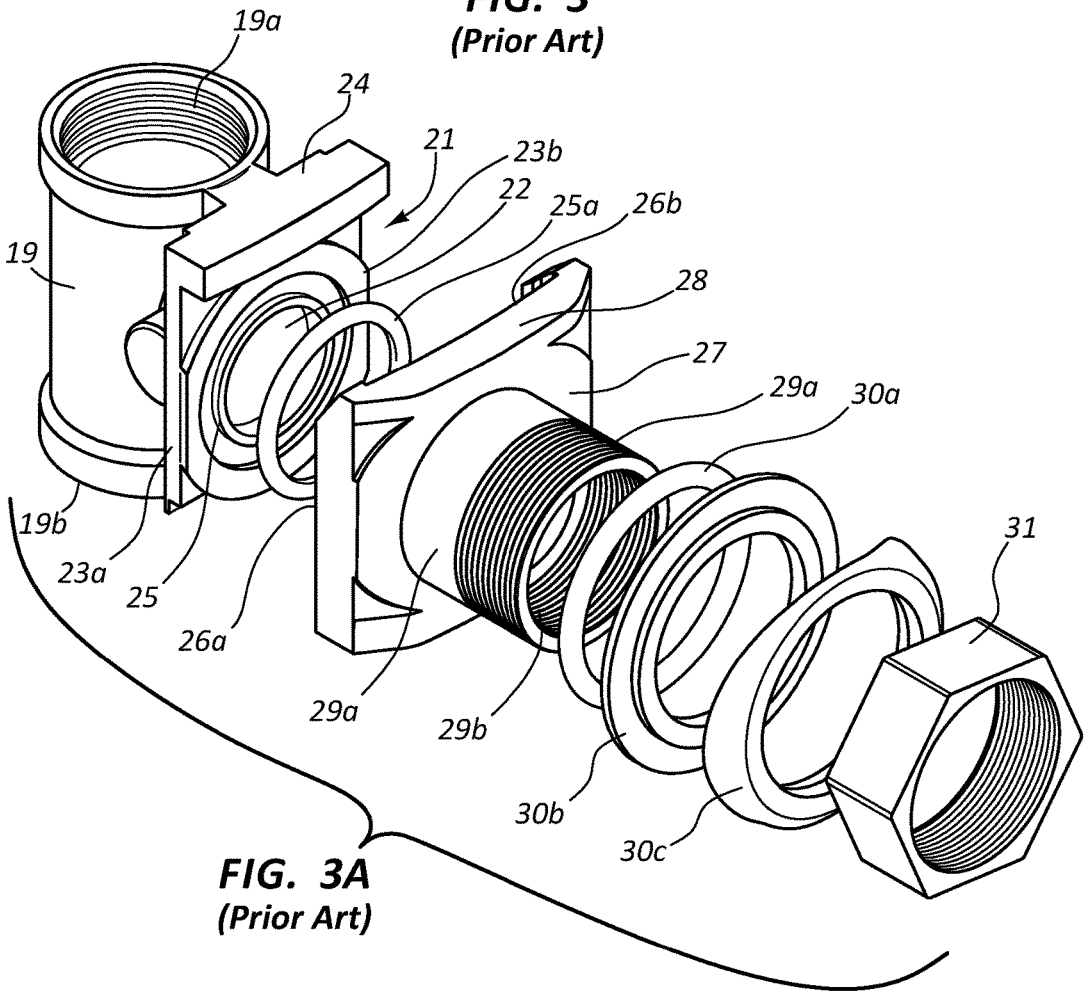
FIG. 3A (Prior Art)
FIG. 3A is also identified as Prior Art and is a view that of FIG. 3 showing a exploded view of the pitless adapter before it is installed through a well casing.

FIGS. 3 and 3A, are also identified as Prior Art, and show, in FIG. 3 the pitless adapter 10 as including a fitting body 19 that is cylindrical and is threaded at top and bottom ends 19*a* and 19*b* to receive, respectively, a well drop pipe threaded end turned into bottom end 19*b*, and receives the outlet pipe 20, as shown in broken lines in FIG. 2, turned into the fitting body 19 threads 19*a*. In FIG. 3A the fitting body 19 is shown as including a side plate 21 that includes a side opening 22 that aligns with a side opening through the fitting body, and which side opening includes a ring seal channel 25 that receives a resilient ring seal 25 a positioned therein. The side plate 21 is rectangular and is secured to the side of the fitting body. Which side plate 21 has parallel sides 23*a* and 23*b*, and includes a shelf 24 formed across a top thereof, between the sides 23*a* and 23*b*. The shelf 24 is to fit over an outer edge of a flat top 28 of a mount 27 that includes sides 26*a* and 26*b* that the side plate 21 sides 23*a* and 23*b* slide between, and dovetail with the sides 26*a* and 26*b*, to where the side plate 21 shelf 24 engages the outer edge of the mount 27 top 28. So arranged, further downward travel of the side plate 21 is blocked by the contact of the undersurface of the shelf 24 with top edge 28 of mount 27.

During which coupling, the resilient ring seal 25*a* is compressed into sealing engagement with the opposing surfaces of the side plate 21 and mount 27 sealing the flow path of water as flows through the side plate 21 opening 22.

As shown in FIG. 3A, an opening is provided through the mount 27 that a drain tube 29 is secured in. Which drain tube 29 includes a threaded ends 29*a*, and mount 27 receives first, second and third washers 30*a*, 30*b* and 30*c*, respectively, fitted over the drain tube 29, and receives a nut 31 turned over the drain tube 29 threads 29*a* completing the assembly. Which third washer 30*c* is shown as being contoured to fit against the outer surface of the mount 27. As shown in FIGS. 3 and 3A, the drain tube 29 includes interior threads 29*b* that a drain pipe, not shown, can be turned into. In practice, the embodiments of the float valve of the invention are preferably contained within a fitting body of a pitless adapter though, it should be understood that the embodiments of the invention, can be installed within a like adapter, within the scope of this disclosure. The adapter 10, as shown in FIGS. 1 through 7, is for installation through an opening formed through a well casing wall prior to the installation of the well casing mounting in a well bore. In which installation, a drain pipe that is an extension of drain tube 29, like those shown in FIGS. 8 through 13 is fitted thereto by connection into inner threads 29*a* of the drain tube 29, shown in FIGS. 3 and 3A and 6 and 7. In which installation, the adapter 10 mount 27 is fitted onto the inner surface of the well casing, over a well casing opening, so as to align with the end of the drain tube 29 that extends through a well casing, as shown in FIGS. 8 through 13. So arranged, the adapter has an upper end fitted onto an end of an outlet pipe 30 with its lower end mounted to the drop pipe 14, and includes the check valve of the invention fitting into the fitting body, as shown in FIGS. 8 through 13, and which drop pipe mounts, on its lower end, the well pump 15.

In assembling the adapter the check valve is installed in the fitting body and, with the outlet pipe 30 fitted onto an upper end and to the drop pipe, that is mounted its lower end to the pump 15, and the assembly is then lowered into the well casing. In which operation, a person on the surface guides the adapter side plate 21 sides 23*a* and 23*b* under and dovetail with, the flange ends 26*a* and 26*b* of the mount 27 until the shelf 24 of the side plate 21 engages the top edge of the mount 27, thereby seating the adapter side plate and mount together. The assembly is thereby secured in the well casing and can be lifted out therefrom by pulling the outlet pipe 30 upwardly.

Figure 4:
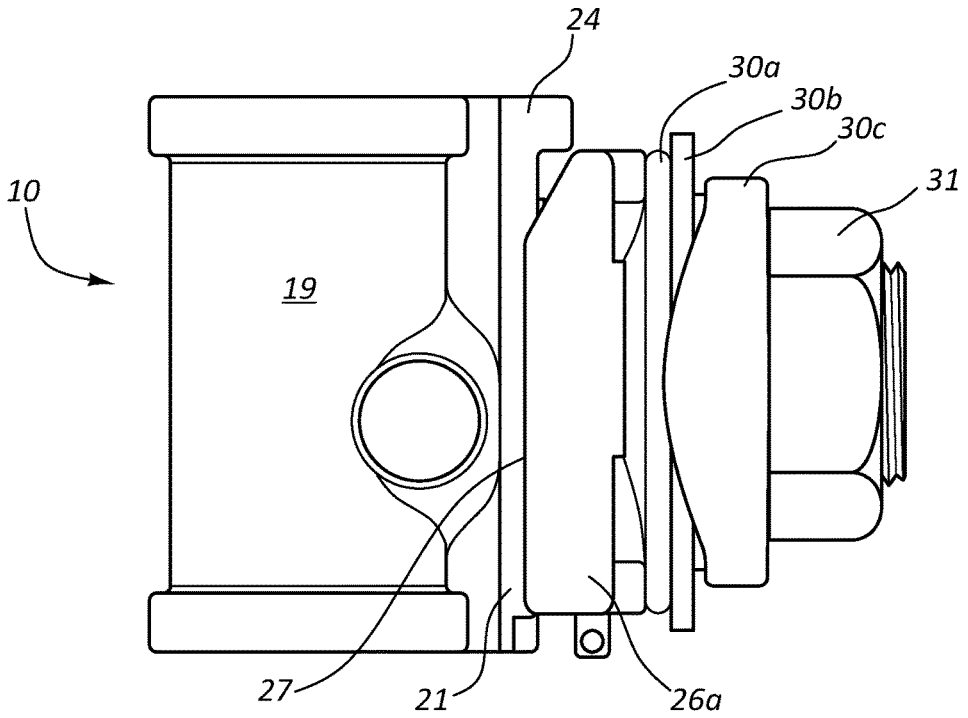
FIG. 4 (Prior Art)
FIG. 4 is also identified as Prior Art and shows a side elevation view of the pitless adapter of FIG. 3.
Figure 5:
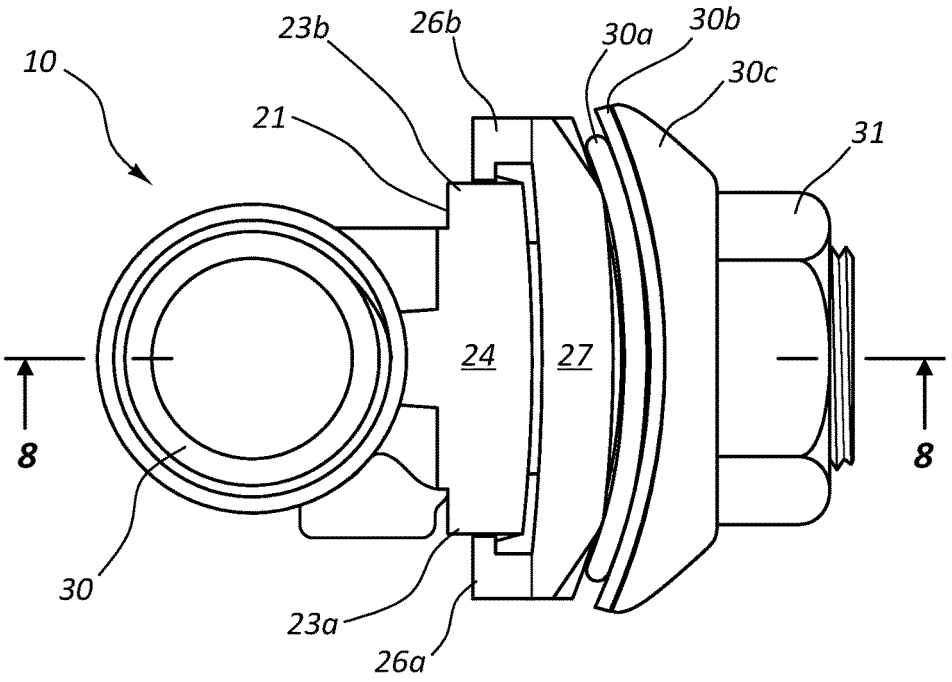
FIG. 5 (Prior Art)
FIG. 5 is also identified as Prior Art and shows a top view of the pitless adapter of FIG. 4.
Figure 6:
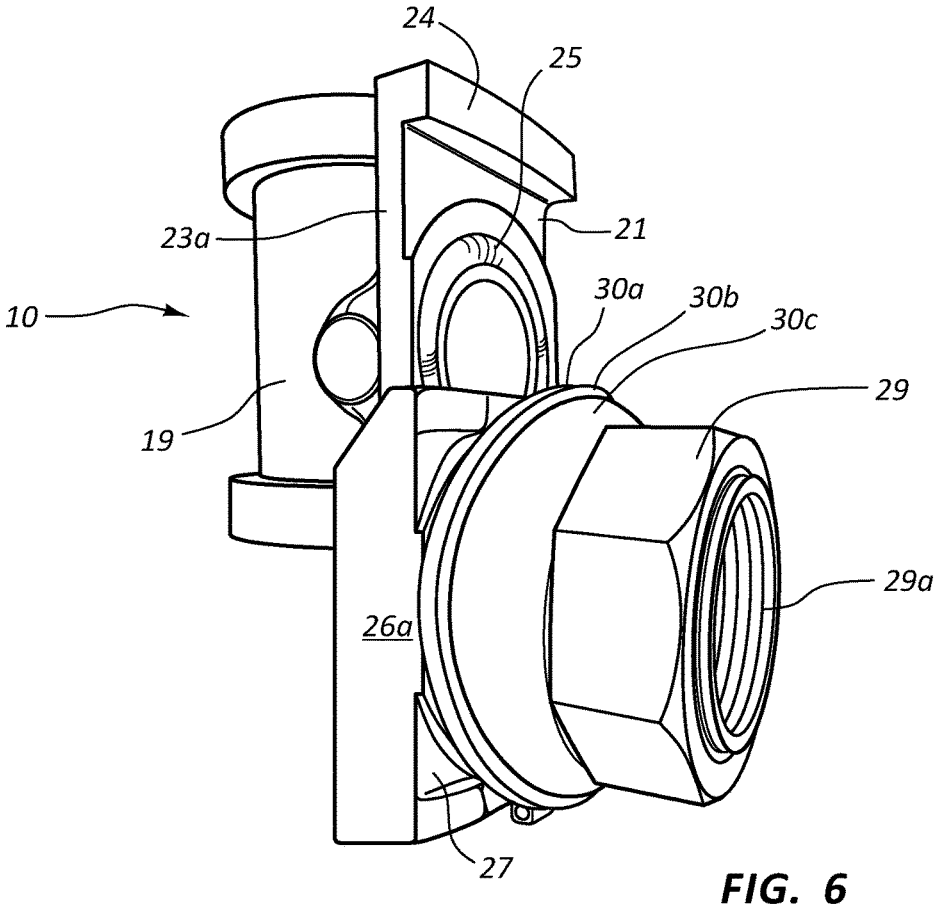
FIG. 6 (Prior Art)
FIG. 6 is also identified as Prior Art shows a side elevation view of the pitless adapter and shows a locking plate secured to the side of the fitting body wherethrough a hole has been formed, and shows the side edges of the locking plate positioned to slide between opposing notched flanges of a slide whereby the hole formed through the side of the fitting body will align with an open end of a drain pipe, and which alignment is provided by travel of a lateral shelf formed across a top end of which adapter locking plate to where it engages a top edge of an adapter mount, and shows a nut aligned for turning over a threaded end of the open end of a drain pipe.
Figure 7:
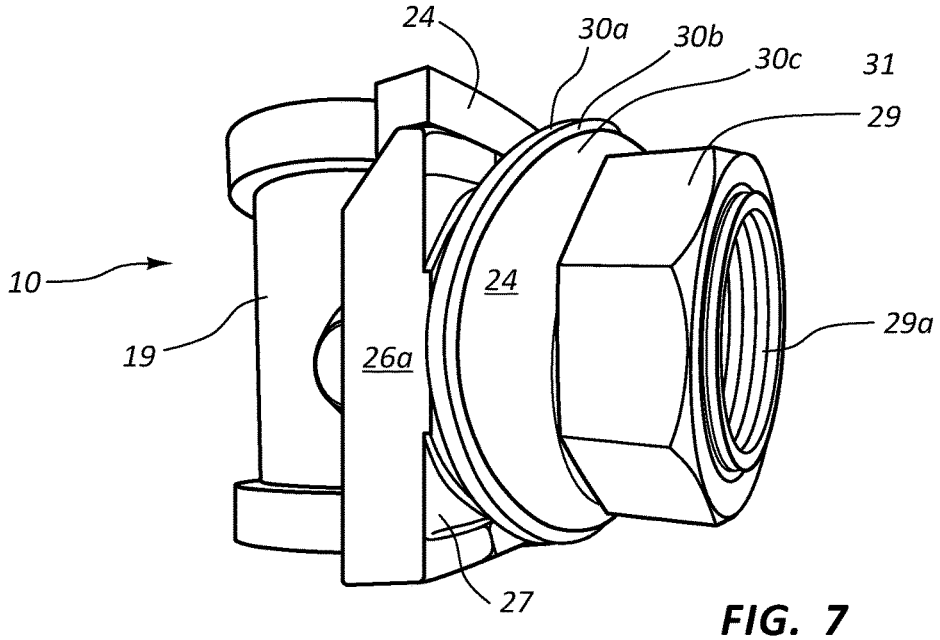
FIG. 7 (Prior Art)
FIG. 7, is also identified as Prior Art and shows the components of the pitless adapter of FIG. 6 as having been assembled together.

FIGS. 4 through 7 as also identified as Prior Art, and FIG. 4 shows a side elevation view of the side coupling of the fitting body 19 side plate 21 and mount 27, and FIG. 5 shows a top plan view of the pitless adapter with the cylindrical opening formed through the fitting body 19 that the embodiments of the check valve of the invention are fitted into. FIG. 6 shows a perspective view of the fitting body 19 side plate 21 aligned for fitting to the mount 27, and FIG. 7 shows a perspective view of the fitting body 19 side plate 21 coupled to the mount 27.

Figure 8:
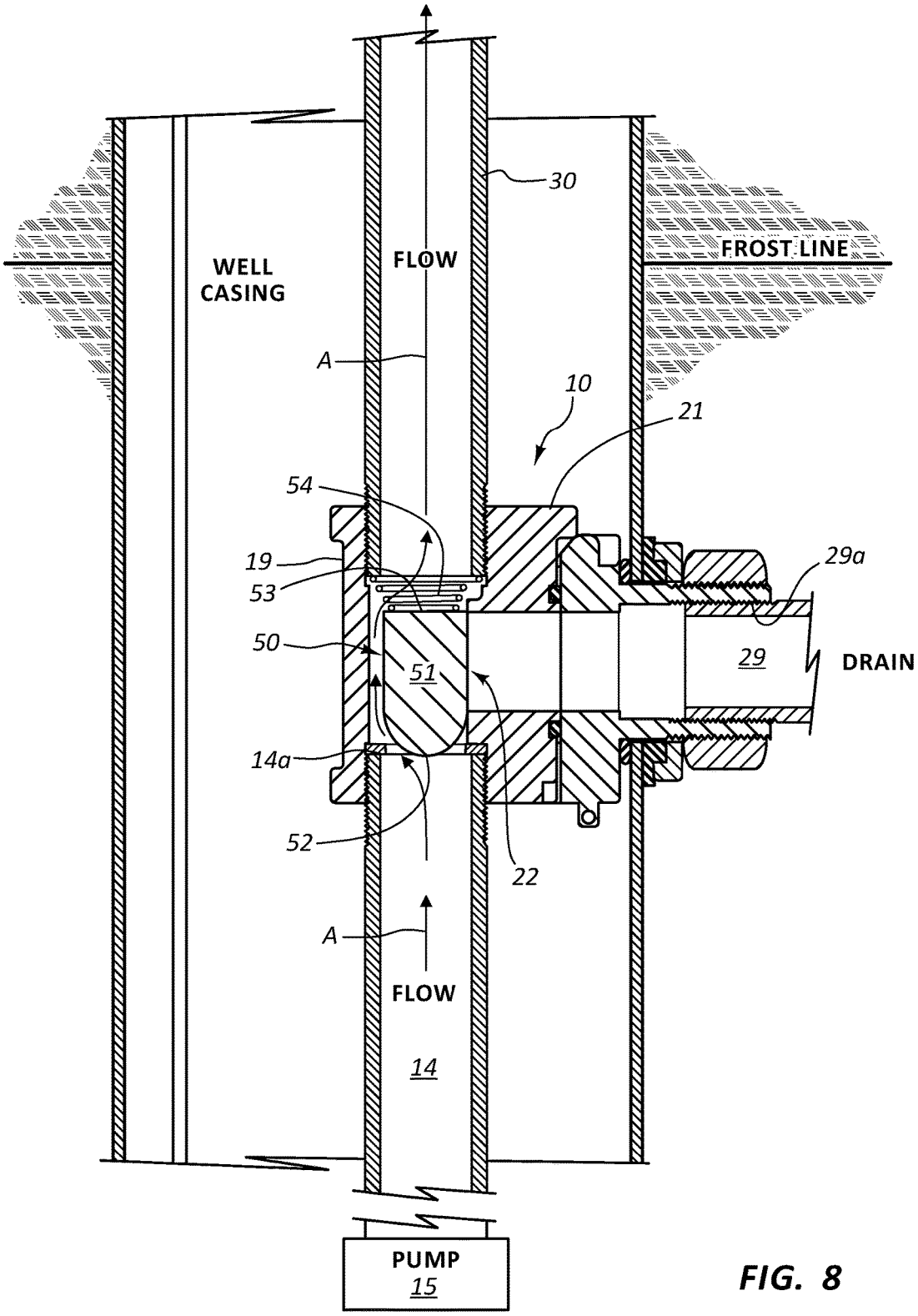
FIG. 8, shows a sectional view taken along the line 8-8 of FIG. 5, that additionally includes a first embodiment of a float valve of the invention that has been fitted into the fitting body of the pitless adapter of FIGS. 1 through 7, that, as required, has been modified to have a larger diameter fitting body to accommodate the components of the float valve therein, and shows a water well casing containing a drop pipe extending upwardly from a water pump, shown as a block, that connects to a bottom end of the modified pitless adapter fitting body, and where the pitless adapter is shown, it should be understood another adapter having like capabilities thereto could be used with the check valve, and shows the adapter as including a mount that is fitted through to the water well casing side and connects to a drain pipe, and shows an outlet pipe fitted to a top end of the adapter fitting body, and shows the check valve as including a check valve piston fitted in the fitting body so as to move vertically, and which piston and is spring biased by a coil spring to urge the piston into the drop pipe open top end that will, as shown, compress to allow a flow of water, arrow A, when the down well pump is operating to pump water.

FIG. 8 is a vertical sectional view taken along the line 8-8 of FIG. 5 showing the adapter 10 of FIG. 5, and further includes a first embodiment of a check valve 50 of the invention contained within a fitting body 19 that, as needed, can have a greater diameter than that of a conventional pitlass adapter. Also, it should be understood, the check valve 50 of the invention along with the other check valve embodiments sent out in FIGS. 9 and 13, can be arranged with an adapter other than the pitless adapter as long as such adapter has essentially the same capabilities and structure, within the scope of this disclosure.

In FIG. 8, the check valve 50 is shown as including a cylindrical piston 51 that has a dome shaped lower end 52 and a flat top end 53. Which dome end 52 is such that, when the piston 51 is positioned in end 14*a* of the drop pipe 14, the curve of the dome will engage and seal against the top inner edge of the drop pipe 14 end 14*a*, sealing thereagainst. The diameter of which piston 51 is such that a flow of water into the check valve 50 will flow between the piston 51 body and an inner wall of the fitting body 19, opposite to the opening in its side wall, and that water flow there around is shown as arrow A. Which flow is passed upwardly into the outlet pipe 30, as shown in FIG. 8. The flow of water urges the piston 51 upwardly, compressing a coil spring 54 and moves the piston side wall across the opening 22 in the adapter side plate 21. So arranged, water is pumped through the drop pipe 14 by pump 15, the force of that flow is directed against the piston 51 dome end 52, and elevates that piston upwardly against the downward biasing of coil spring 53, urging the piston outer surface across the opening 22 in side plate 21, blocking water flow to a drain pipe 29, and allowing the water flow to travel alongside the piston 51 cylindrical body and into the outlet pipe 30.

Figure 9:
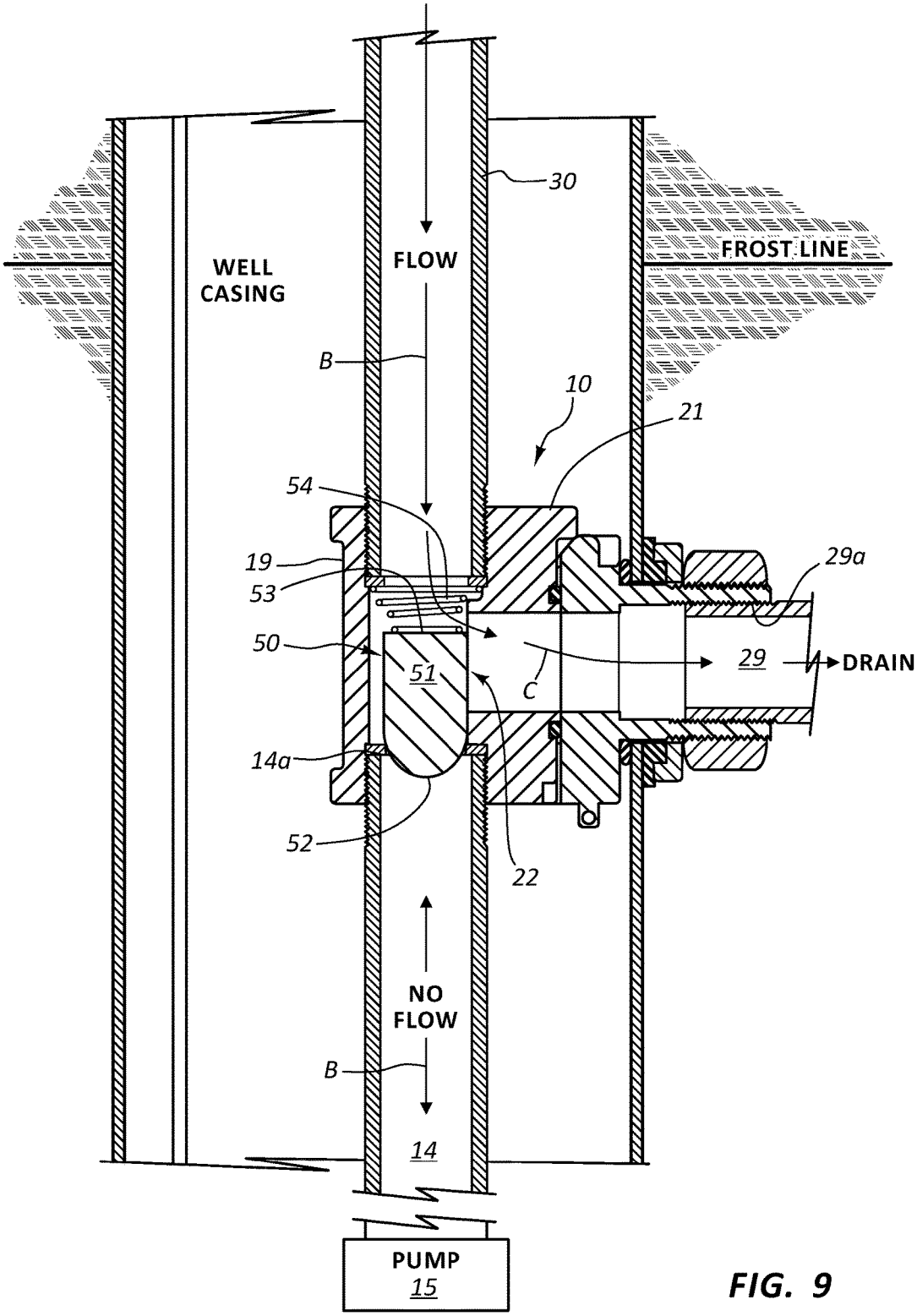
FIG. 9 shows the arrangement of FIG. 8 with the pump flow shown as arrow B as having been stopped, allowing the coil spring to flex to urge the piston end into closure over the drop pipe top end, and shows the piston top end as having moved downwardly to expose the adapter opening to a drain flow, arrow C, from the drop pipe that passes out of a drain opening and down the outside of the well casing.

FIG. 9 illustrates that, when the pumped flow of water through the drop pipe 14 is halted, the piston 51 coil spring 53 will then extend to urge the piston 51 dome end 52 into the drop pipe 14 end 14*a*. Also, shown in FIG. 9, the downward travel of piston 51 moves the piston 51 flat end 54 downwardly, opening a space between the piston flat end 54 to the opening 22 through side plate 21 as to allow water, as would otherwise be contained above the piston 51, to travel thereacross, with that water emptying from the flow pipe 30 through the adapter plate side plate 21 opening 22, and the mount 27 opening, and into drain pipe 29 that extends beyond the side of the well casing 16, with the water traveling therethrough to flow down the outside of the well casing 16. Which drain pipe 29 is installed below the frost line.

Figure 10:
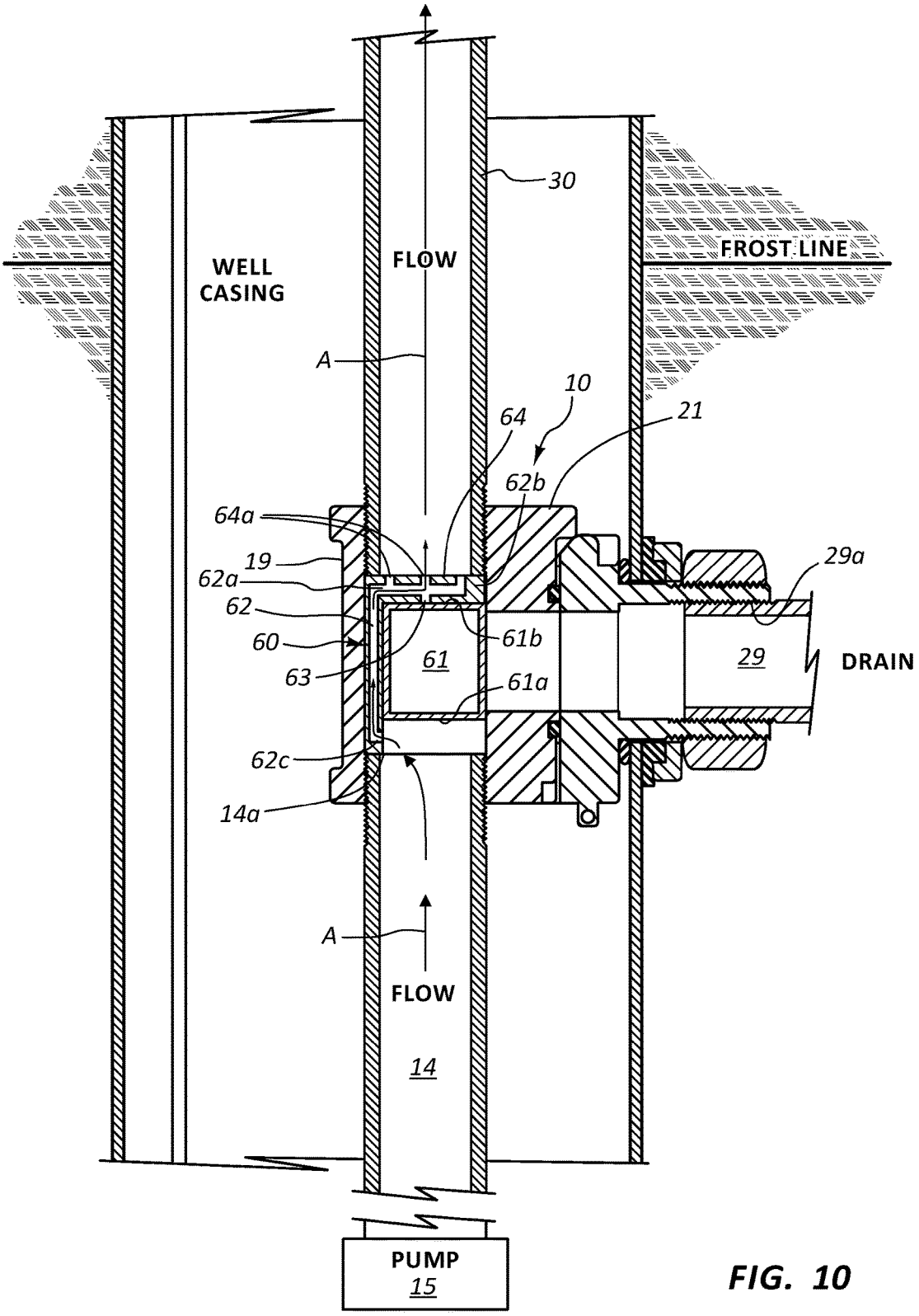
FIG. 10 shows a second embodiment of the check valve of the invention that is also for installation in the well casing, to an adapter having a fitting body having a diameter to accommodate the check valve and is distinct from the check valve piston arrangement of FIGS. 8 and 9, in that it utilizes a valve that is fitted into the fitting body to float therein on a column of water pumped up from the end of the drop pipe, that lifts the valve off of the drop pipe end, allowing the pumped water flow, arrow A, to travel through the fitting body, and the side of which float blocks passage through the adapter side opening in the mount and through a drain pipe.

FIG. 10 shows another embodiment of a check valve 60 that, like the embodiment of check valve 50*f*, of FIGS. 8 and 9, is preferably for arrangement with the described pitless adapter 10, but, it should be understood, can be arranged with a like adapter 10, within the scope of this disclosure. As shown, the check valve 60 is for fitting in a the fitting body 19, like the check valve 50 of FIGS. 8 and 9, but, distinct therefrom, involves a cylindrical float 61 rather than the piston 51, and which float 61 is arranged to travel up and down freely within a cage 62 that the cylindrical float is fitted into, to freely travel vertically, lifting off of an end 14*a* of drop pipe 14 that the float 61 lower end 61*a* engages. So arranged, with water traveling through the check valve 60, the float 61 upper end 61*b* is in contact with a top surface 62*a* of the cage 62, as shown in FIG. 10. To accommodate which pumped water flow, the float 61 lifts off of the end 14*a* of the drop pipe 14, allowing the flow, arrow A, to travel across the lower end 62*c* of cage 62, upwardly between the fitting body 14 inner surface and outer surface of cage 62, through the holes 64*a* of disk 64 fitted across the outlet pipe 30 end, to travel therethrough.

Figure 11:
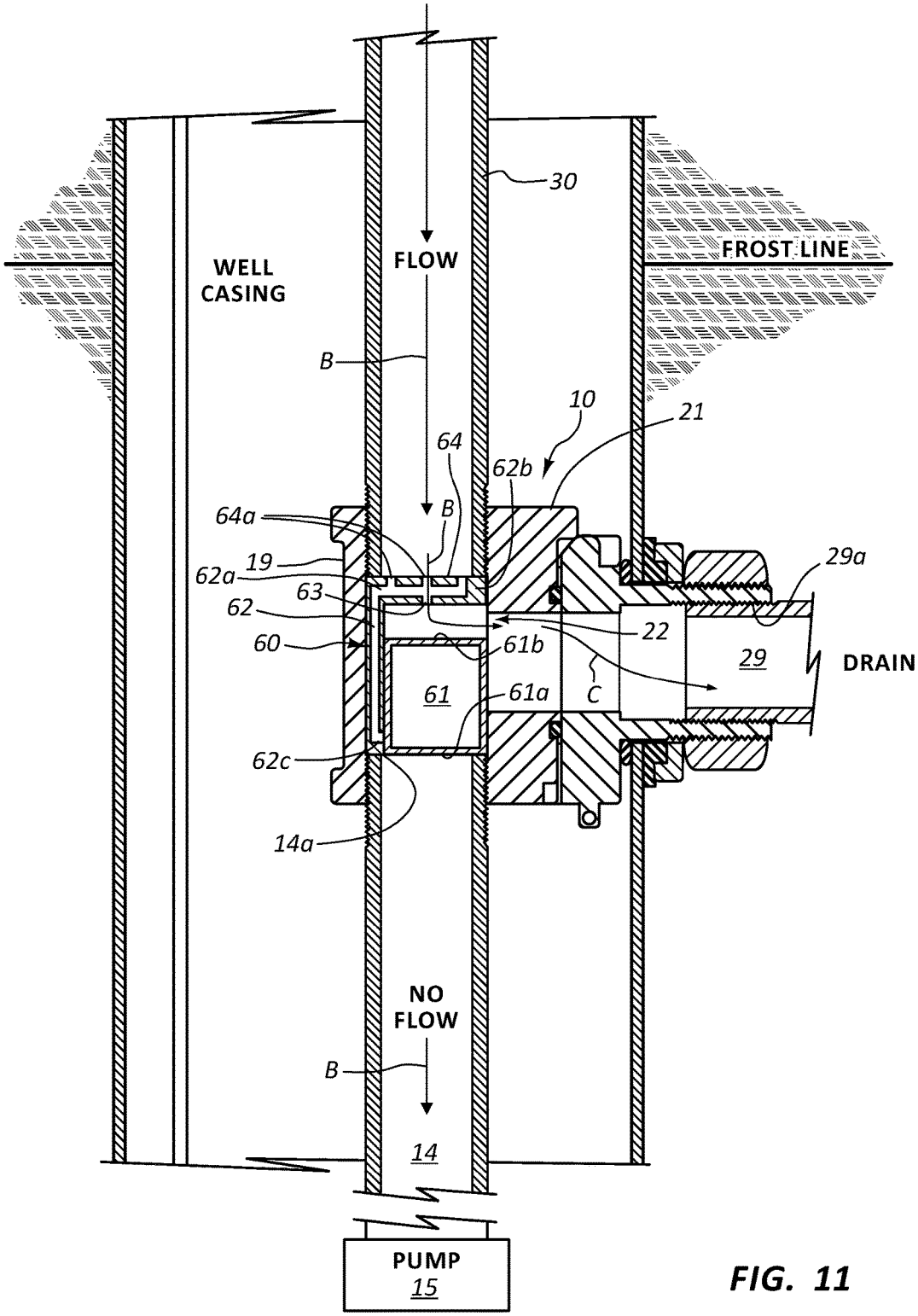
FIG. 11, is a view like that of FIG. 11, only showing the upward water flow as having stopped, arrow B, allowing the valve to drop, closing over the drop pipe end, blocking a back flow therethrough and opening the opening through the adapter side plate and mount to pass water from the flow pipe and out of the valve into and through a drain pipe.

To allow which water travel, the cage 62 top surface 62*a* forms a right angle to the cage side and connects, on its opposite end, to a right angle bend 62*b* that connects to the side of the fitting body 19, above the side plate 21 opening 22 that aligns with the opening through the well fitting body. Which fitting of the cage 62 to the fitting body is such that the float side fits closely over the opening through the fitting body. So arranged, with the water flow, arrow A, that flow lifts the float that then travels in cage 62, opening a space between the cage 62 lower end and drop pipe 14 end 14*a*, allowing the water flow to travel from the check valve 60 and up through the outlet pipe. With water flowing, arrow A, the float 62 top end will have closed over a hole 63 formed through the cage top surface 62*a*, blocking water traveling therethrough as occurs when the water flow is discontinued, as shown in FIG. 11, and discussed below. Also, the force of the water flow urges the side of the float 61 into sealing engagement over the opening 22 through the adapter side plate 21. So arranged, the side of the float 61 is positioned across the opening 22 through the adapter side plate 21, blocking water passage into the drain pipe.

FIG. 11 shows the float 61 of the check valve 60 as having dropped in the cage 62 such that the float 61 lower end 61 a engages the drop pipe 14 end 14*a*, blocking a water back flow through the gap between the cage end 62*c* and drop pipe 14 end 14*a*, and the float 61 top end 62*b* has moved away from the cage top end 62*b*, uncovering the center hole 63 therethrough. With water then draining through the check valve 60, shown as arrow B, through the opening 63, and across the float 61 top end 61 a, shown as arrow C, and into the opening 22 through the adapter side plate 21 and out of the drain pipe 29. Which drain pipe 29 extends beyond the side of the well casing 16, with the water traveling therethrough to flow down the outside of the well casing 16, and the drain pipe 29 is preferably installed below the frost line.

Figure 12:
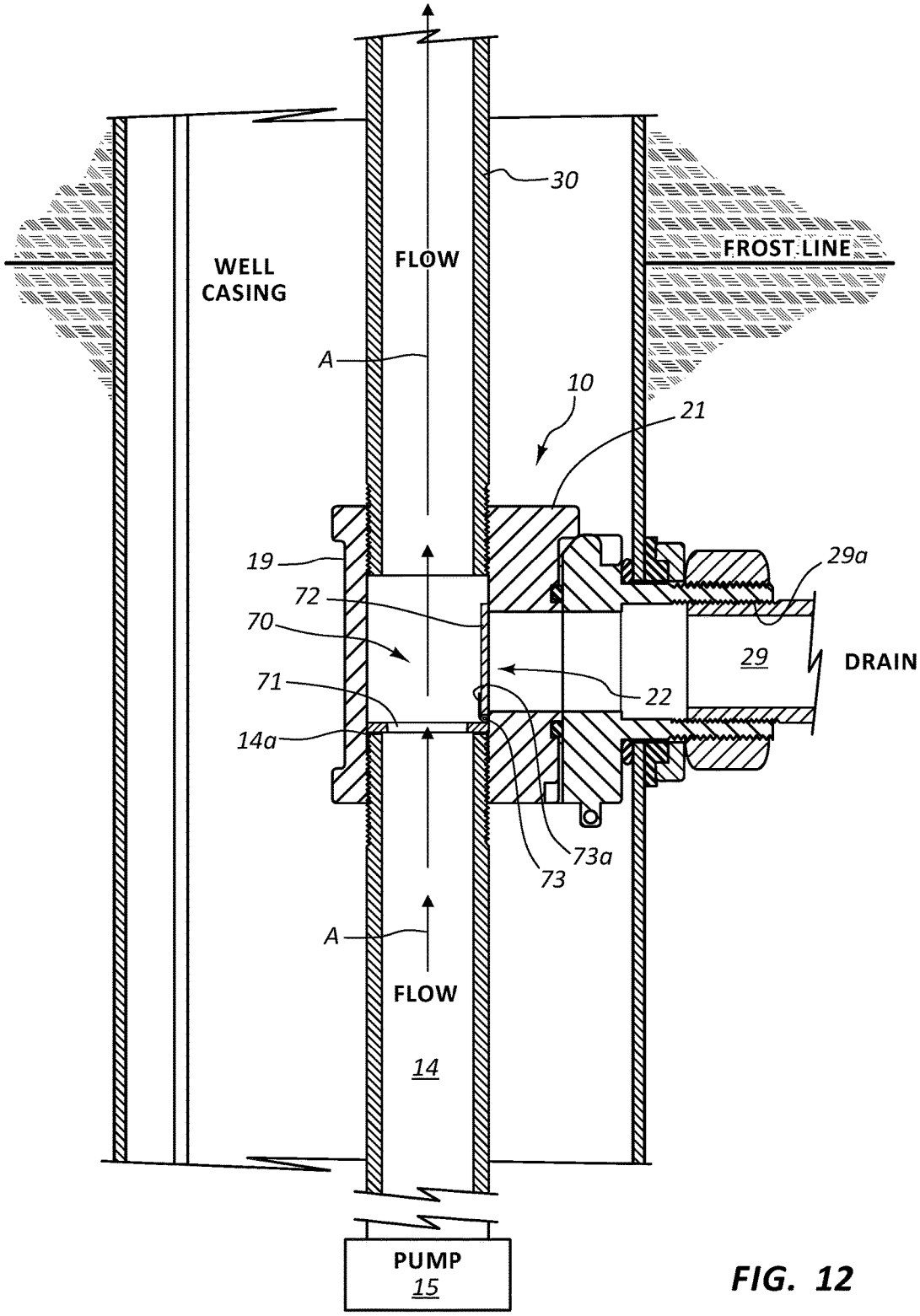
FIG. 12, shows yet another embodiment of the check valve of the invention that, like the embodiments of FIGS. 8 through 11, is also preferably for inclusion in the fitting body of a pitless adapter, those a like adapter could be so used, and may include a larger diameter fitting body than that of a pitless adapter, to accommodate the check valve, and is open through the side of the adapter mount that is connected through the well casing, and is connected between the drop pipe top end and the outlet pipe lower end, and includes a flat plate that is pivot mounted in the fitting body by a spring to bias the flat plate from across the top end of the drop pipe to cover the opening through the adapter side plate and mount when a flow of water is passed out from the drop pipe end, arrow A.
Figure 13:
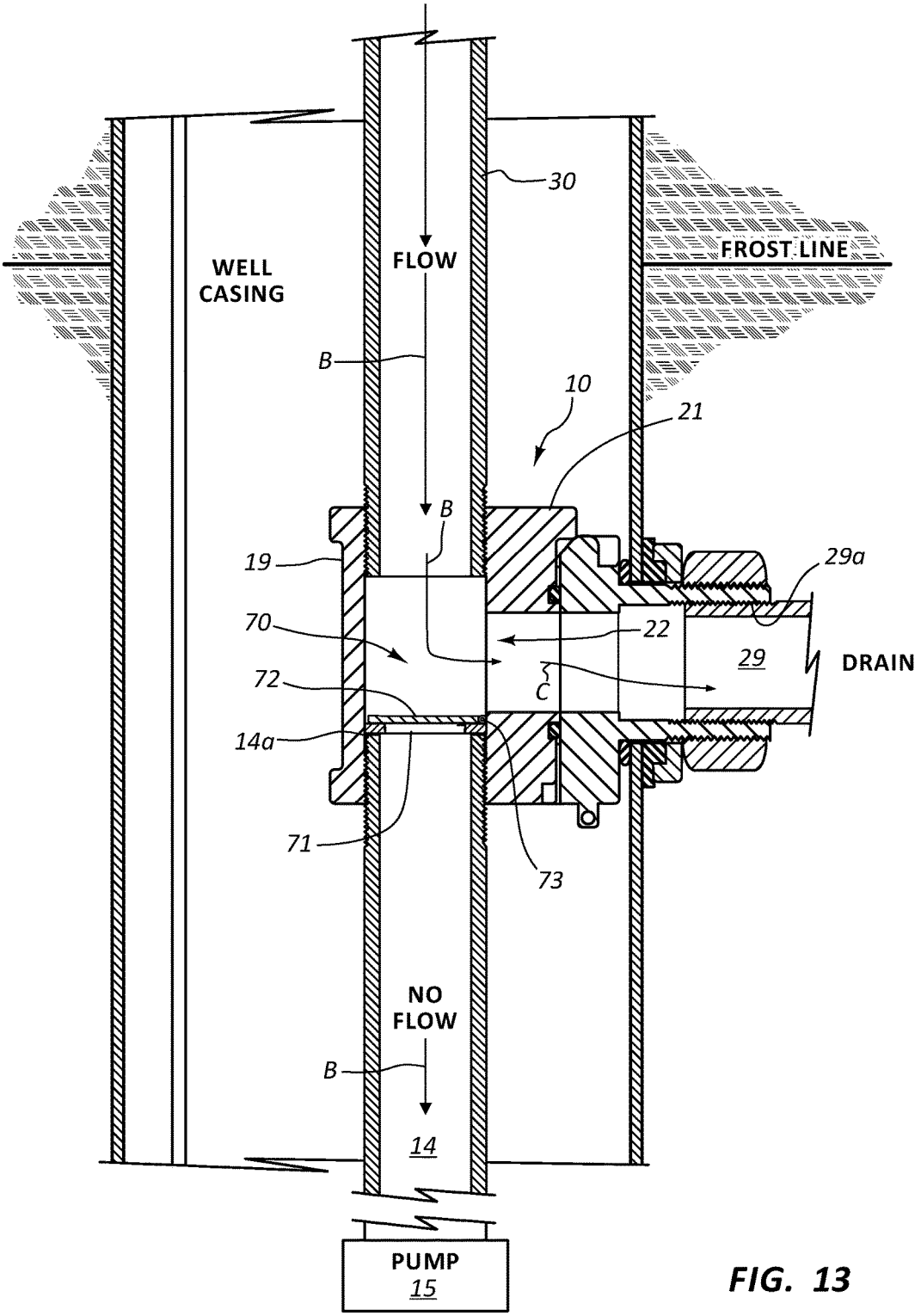
FIG. 13 shows the check valve configuration of FIG. 12, except that the flow of water has been shut off, allowing the spring biasing of the pivoting plate to close over the drop pipe end, shown as, arrow B, allowing the flat plate to pivot over the drop pipe end, and which plate pivoting unplugs the opening through the adapter side plate and mount, allowing a drain water flow to travel out of the outlet pipe, arrow C.

Still another embodiment of the check valve of the invention is shown in FIGS. 12 and 13 as check valve 70 that includes a flat plate 72 that is round and has a diameter to fit across and seal against both the edge of the opening through the fitting body that aligns with the opening 22 through the adapter side plate 21 when water is flowing through the check valve, and will rotate to cover over a center opening 71 through a disk 73 that is secured across the top end 14*a* of the drop pipe 14 when water is not flowing through the check valve 70. The flat plate 72 is attached at its edge to a spring hinge 73, that functions similarly to a cabinet door hinge, in that it will pivot the flat plate 72 over the the center opening 71, as shown in FIG. 13, when a flow of water is not passing through the check valve 70, arrow B, and that spring biasing will be overcome to lift that flat plate 71 to the attitude shown in FIG. 12, covering over the fitting body opening that aligns with opening 22 of the adapter side plate 21 when a water flow, arrow A, is present. The force of which upward water flow presses the flat plate 71 into sealing engagement over the fitting body opening, with the water flow, arrow A, thereby passing through the check valve 70 and into the outlet pipe 30.

Where, as shown in FIG. 13, a water flow, arrow B, is not present, as when the pump 15 is turned off, the spring hinge 73 urges the flat plate 71 over the opening 22, closing over the drop pipe 14 end 14*a*, trapping water as is present in the check valve 70 and outlet pipe 30. That trapped water, as shown in FIG. 13 thereby drains through the fitting body opening that aligns with the opening 22 of the adapter side plate 21, and into the drain pipe 29, arrow C, that dumps the water into the ground beyond the well casing 26, prohibiting that trapped water from flowing back into the ground water supply, avoiding water contamination.

The check valves 50, 60 and 70 of the invention are each for installation with an adapter like the pitless adapter set out as prior art, and provide for releasing of water trapped above the drop pipe end when water pumping from pump 15 is stopped, and for directing that trapped water out through a drain pipe 29, that exhausts the water beyond the well casing. Thereby, water as could be present above the drop pipe 14 end 14*a*, that is above the frost line, and could freeze causing a blockage to a water flow from the pump 15, potentially damaging that pump, will not be present, nor will it have drained back through the pump 15 and into the ground water supply, possibly contaminating that water supply.

Although preferred embodiments of the invention have been shown and described herein, it should be understood that the present disclosure is made by way of example only and that variations are possible, within the scope of this disclosure, without departing from the subject matter coming within the scope of the following claims and reasonable equivalency thereof, which claims I regard as my invention.

I claim:

1. A sanitary check valve for draining water above a frost line through a drain pipe, away from the outside of a well casing, when pumping from a water source is stopped comprising, an adapter having a fitting body that is of a size to accommodate a check valve fitted therein to allow a water upward flow and a drain flow, and consists of a side plate and a separate mount, where said side plate has an opening therethrough and connects to said fitting body that is to connect on a lower end to a drop pipe and on an upper end to an outlet pipe, which said side plate has parallel sides and has a shelf extending outwardly from a top surface thereof for releasably connecting to said separate mount that attaches through said well casing side and has a drain pipe extending therefrom that fits through said well casing opening and said side plate parallel sides that fit within said well casing and a flat top surface of said shelf that contacts a flat top of sad separate mount when said side plate is slid between said separate mount parallel sides, providing a releasable coupling of said side plate and said separate mount together when said adapter mounting said drop pipe and outlet pipe are lowered into said well casing; a check valve for installation in said fitting body that is arranged to freely travel vertically in said fitting body, between said top end of said drop pipe and is in covering relationship across said opening through said side plate water is flowing upwardly through said drop pipe and said check valve, where said top end of said drop pipe is covered by a lower surface of said check valve body and, which said check valve body moves across, to cover, said open end of said drop pipe and moves to open said opening through said adapter side plate to pass a drain water flow from said outlet pipe and said check valve, when the upward pumped water flow is discontinued, to dump said drain water flow to the outside of said well casing and said check valve has a cylindrical body, with a dome shaped lower end and a flat top end with said dome shaped lower end to fit in, in sealing engagement with, said top end of said drop pipe, and an end of a coil spring engages said cylindrical body flat top end, biasing said cylindrical body towards said top end of said drop pipe, and said coil spring fits between said cylindrical body flat top end such that said coil spring opposite end is in engagement with a top surface of the fitting body to bias said check valve body dome shaped lower end to cover over the top end of the drop pipe when water is not flowing upwardly through said drop pipe.

* * * * *